US008088019B1

(12) United States Patent
Long et al.

(10) Patent No.: US 8,088,019 B1
(45) Date of Patent: Jan. 3, 2012

(54) ADJUSTABLE DRIVER HOSEL

(75) Inventors: D. Clayton Long, Carlsbad, CA (US); Michael R. Cummings, Vista, CA (US)

(73) Assignee: Plus 2 International, Inc., Carlsbad, CA (US)

( * ) Notice: Subject to any disclaimer, the term of this patent is extended or adjusted under 35 U.S.C. 154(b) by 282 days.

(21) Appl. No.: 12/574,245

(22) Filed: Oct. 6, 2009

(51) Int. Cl.
*A63B 53/02* (2006.01)

(52) U.S. Cl. ..... 473/245; 473/288; 473/307; 473/309

(58) Field of Classification Search ..... 473/288, 473/307, 309, 245–248
See application file for complete search history.

(56) References Cited

U.S. PATENT DOCUMENTS

| | | | | |
|---|---|---|---|---|
| 1,352,020 | A | 9/1920 | Olson | |
| 3,430,957 | A * | 3/1969 | Andis | 473/248 |
| 3,477,720 | A * | 11/1969 | Shafie | 473/245 |
| 3,524,646 | A | 8/1970 | Wheeler | |
| 5,197,733 | A | 3/1993 | Schroder | |
| 5,390,920 | A | 2/1995 | Nickum | |
| 5,433,442 | A | 7/1995 | Walker | |
| 5,692,969 | A * | 12/1997 | Schooler | 473/313 |
| 6,368,230 | B1 | 4/2002 | Helmstetter et al. | |
| 6,547,673 | B2 | 4/2003 | Roark | |
| 6,890,269 | B2 | 5/2005 | Burrows | |
| 7,083,529 | B2 | 8/2006 | Cackett et al. | |
| 2006/0281575 | A1 | 12/2006 | Hocknell et al. | |
| 2006/0287125 | A1 | 12/2006 | Hocknell et al. | |
| 2006/0293115 | A1 | 12/2006 | Hocknell et al. | |
| 2006/0293116 | A1 | 12/2006 | Hocknell et al. | |
| 2007/0054749 | A1 | 3/2007 | Hocknell et al. | |
| 2007/0078026 | A1 | 4/2007 | Holt et al. | |
| 2008/0293510 | A1 * | 11/2008 | Yamamoto | 473/308 |
| 2009/0075749 | A1 | 3/2009 | Cruz et al. | |
| 2009/0124407 | A1 | 5/2009 | Hocknell et al. | |
| 2011/0021282 | A1 * | 1/2011 | Sander | 473/288 |
| 2011/0207547 | A1 * | 8/2011 | Sander et al. | 473/307 |

OTHER PUBLICATIONS

Ellis, Jeffrey B., "The Clubmaker's Art—Antique Golf Clubs and Their History", vol. 2, p. 467, Zephyr Productions, First Edition, Jan. 1997, USA.

Web page http://press.tmag.com/2009/01/19/taylormade-introduces-r9-and-r9-tp-drivers detailing the specifics of the TaylorMade R9 Driver and R9 TP Drivers, TaylorMade Golf Co. press release date Jan. 19, 2009.

* cited by examiner

*Primary Examiner* — Stephen L. Blau
(74) *Attorney, Agent, or Firm* — Smith Gambrell & Russell LLP

(57) ABSTRACT

An adjustable golf club is disclosed having a hosel with a spherical section and positioning linkage that allows the face angle of the head to be changed without changing the lie angle or rotating the shaft around its axis. The hosel is fixed in place by tightening the spherical surface of a compression nut against the spherical section of the hosel and a receiving compression cup with matching spherical surface radiuses, along with a slotted rotation prevention section consisting of two flat surfaces, a threaded linkage engaging the lower hosel piece and anchored to a tube attached to the skirt of the head. The linkage is used to threadably position the angle of the hosel piece. The invention also provides a quick and easy way to remove and replace the hosel piece along with the shaft for additional customization of the club.

12 Claims, 10 Drawing Sheets

SECTION E-E

SECTION F-F

SECTION A—A

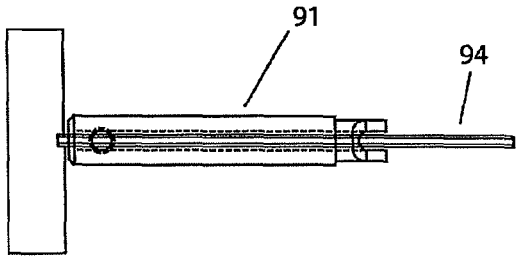
FIG. 18
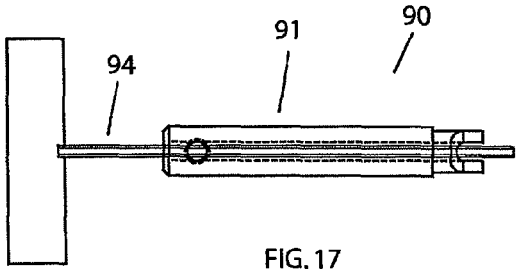
FIG. 17
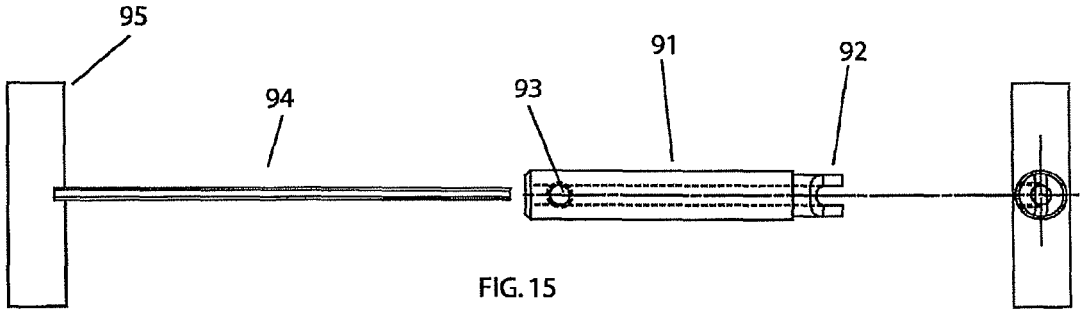
FIG. 15
FIG. 16
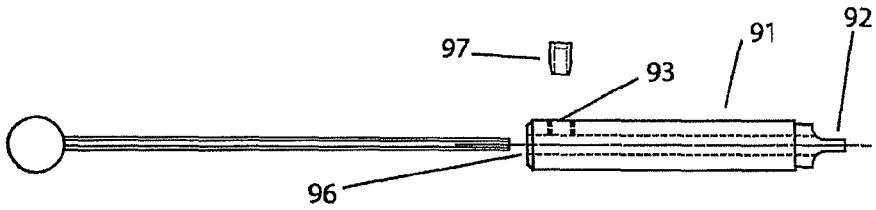
FIG.14

ADJUSTABLE DRIVER HOSEL

FIELD OF THE INVENTION

This invention relates generally to improvements to golf clubs. More particularly this invention relates to improvements in adjustability of club head orientation to shaft axis position and the resulting ability to customize certain golf club playing characteristics to the individual player. In addition to head to shaft orientation adjustments, this invention also provides a means of easily and quickly interchanging entire shaft and grip assemblies to further customize the golf club to the individual.

BACKGROUND OF THE INVENTION

It is well known in the art, that changing the angularity of the shaft axis in relation to the golf club head changes important playing characteristics such as the loft angle of the face and lie angle. Face loft angle is generally considered to be the angle between the plane of the face, or tangent plane to the center of the face if the face is not flat, and the shaft axis. The lie angle is generally considered to be the angle between a plane parallel to the ground, and tangent to the sole center, and the shaft axis. In addition, more particularly in wood type clubs, the shaft axis angularity also changes the face angle at address, the face angle considered to be the angle between a vertical plane passing through a line normal to the face surface center and perpendicular to the ground plane and a plane perpendicular to a vertical plane passing through the shaft axis and perpendicular to the ground plane. Altering these angles changes the way a club head reacts with a golf ball at impact making ball flight higher or lower, or more apt to fly to the right or left depending on the direction and magnitude of the angle variations. Since individuals swing golf clubs differently, and present the club head to the ball in varying attitudes and directions, setting the position of the golf club head in relation to the shaft axis in a more optimum orientation can facilitate dramatic improvements in ball flight for a given individual.

Golf clubs have been typically manufactured with separate club heads, shafts and grips. These three main components are generally fixed together before sale, the grip attached to the shaft by means of sliding over a layer of double face tape wetted with a solvent, and the head to the shaft by means of shaft insertion into a hole in the head and an epoxy bond. Using these conventional methods the angularity of the head and shaft are permanently fixed and cannot be easily altered.

In wood type clubs where tube like extensions to the heads called hosels contain part or all of the shaft bore holes, these hosels can be bent to alter the shaft axis angle to the head. However, this requires special tools and elaborate fixtures to hold the head while bending the hosel and can easily damage or break the head. In this conventional assembly arrangement, changing the shaft requires the epoxy bond to be broken with the application of heat. Since many of today's driver and wood shafts are of graphite composite construction, the epoxy bond must be carefully heated and the shaft pulled by a special apparatus designed not to twist the shaft while extracting.

Because of the great difficulty in altering the shaft orientation to the club head, as well as interchanging the shafts themselves, manufacturers and been forced to produce a wide range of individual clubs exhibiting different face angles and loft angles along with different shaft types to better accommodate the preference and skill level of the individual golfer. The result being increased manufacturing cost due to multiple tooling as well as increased inventory and stock keeping units (SKUs) for both manufacturer and retailer.

Most prior art has resorted to a means of off angle shaft bore rotation to change the orientation of the shaft axis to the golf club head. These designs rely on a spline or other method of rotation fixation along with a fastener such as a hold down bolt or compression clamping nut to lock the assembly in place. These methods have several short comings which the present invention overcomes. The prior art methods of off angle bore rotation require the face angle and lie angle to be simultaneously changed during rotation. To close the face angle from a neutral position, the lie angle must become either flatter or more upright. Likewise, to open the face angle, the lie angle must again become either flatter or more upright. This is the result of the off angle bore axis sweeping through a conical shape surface as it rotates. Another shortcoming of the off angle bore rotation method is that the shaft and grip together must rotate into a new clock position. This introduces certain inconsistencies caused by shaft straightness and shaft bending differences based on clock position sometimes referred to as a shaft spine. This method must use a round grip and prevents the use of a reminder grip design as well as traditional grip graphics that aid the golfer in repeating grip location. Still another short coming of the prior art designs is a finite number of adjustments within the adjustment range. Using a spline or other rotation limiting methods, the adjustments are limited to the number of teeth or other such segments on the clocking mechanism.

The present invention seeks to solve the above short comings of the prior art by allowing the face angle of a wood type club to be changed independently of lie angle and without the shaft and grip assembly rotating to a different clock position. The invention also allows an infinite number of positions to be attained within its range of motion of adjustment. The present invention also allows fast and easy shaft/grip assembly interchangeability to customize shaft type for an individual.

One example of the prior art is U.S. Pat. No. 7,083,529 B2 to Cackett et al. for a Golf Club with Interchangeable Head-Shaft Connections. The Cackett patent discloses two interconnected tubes, the bottom tube is secured in the club head by suitable means, the upper tube fits inside of the bottom tube and interconnects by means of complimentary interacting surfaces on the bottom tip such as a spline along with a matching tapered section above the spline to provide a tight rattle free fit. The upper tube is bored from the top for insertion and bonding of a golf shaft and is held in place by a mechanical fastener such as a screw entering from the bottom sole and threaded into the bottom section containing the spline. The arrangement is an effort to reduce material weight and provide a means of quick shaft interchangeability.

Another example of the prior art, U.S. Publ. Pat. App. No. US 2006/0287125 A1, discloses a similar arrangement to U.S. Pat. No. 7,083,525 to Cackett but adds a shaft axis bore in the upper tube that is off angle to the axis of the bottom tube. This off angle embodiment allows for the rotation and fixation of the shaft carrying upper tube and thus alterations in the loft, face angle, and lie of the club head. However, this arrangement leaves the angular alterations of the head and shaft axis interconnected and dependent upon one another, not allowing independent change of any of these angles.

Still another example of the prior art, U.S. Pat. No. 5,390,920 to Nickum, depicts and adjustable head with the lower most end of the shaft terminating in a sphere or pivot ball. The sphere is enclosed in an internal bore and engaged from the bottom side by a clamping screw that compresses and locks the sphere in place when tightened. The shaft and sphere can freely rotate when the clamping screw is loosened. This example provides no positive indexing method for shaft angle location and relies solely on the friction between the sphere and clamping surfaces to hold position during impact, something not realistic for anything other than a putter type club.

Yet another example of the prior art, U.S. Pat. No. 6,368,230 to Helmstetter, shows an off angle rotating sleeve inserted into a wood type golf head with indexing detents to locate the clock position of the sleeve and thus the shaft axis position. Again as with all rotating off angle systems, the lie and face angles are interdependent upon each other, and also requires the shaft to clock as the off angle bore rotates.

SUMMARY OF THE INVENTION

In accordance with the present invention, an adjustable connection mechanism is provided between the golf club head and the shaft/grip assembly that allows face angle alteration independent of lie angle without requiring the rotation of the shaft/grip assembly. The invention also allows fast and easy shaft/grip assembly interchangeability.

In general, a hosel is provided with an top cylindrical section containing a portion of the cylindrical shaft bore hole for the insertion and bonding of a golf shaft end. The hosel has an upper spherical section that is spherically shaped and contains the lower portion of the shaft bore. The upper spherical section is truncated at the bottom by an intermediate rotation prevention section with two opposing external flat sides and a bottom connector section with a threaded hole perpendicular to the shaft bore hole.

The hosel is received into a cup piece within the head having a top threaded section, a central spherical section with mating spherical surface to the hosel's upper spherical section, and a bottom rotation prevention section with interior flat sides for mating with the exterior flat sides of the intermediate rotation prevention section of the hosel.

A compression or clamping nut is provided that fits over the top cylindrical section of the hosel and clamps the central spherical section of the cup piece to the spherical surface of the upper spherical section of the hosel. The interior bore diameter of the compression nut is large enough to allow the top cylindrical section of the hosel to tilt several degrees about the sphere's center. An o-ring is positioned between the clamping nut and top cylindrical section of the hosel to seal the joint surfaces from contaminants.

The horizontally threaded hole of the hosel piece is engaged by the right hand threaded end of a screw with left hand threads on the opposite end. This right hand/left hand screw is engaged on the opposite end by an adjustment nut which has internal left hand threads matching the screw and external right hand threads that match the pitch of the opposite right hand threaded end of the screw. The adjustment nut is threaded into an internal skirt tube in the body of the club head. The threads in the threaded hole of the hosel are loose enough to allow the left hand/right hand screw to push and pull the bottom connector section of the hosel and rotate the hosel about the spherical center of the ball joint when the clamping nut is loosened. The exterior flat sides of the intermediate rotation prevention section of the hosel engage the interior flat sides of the slotted hole in the cup piece in a slip fit to prevent rotation of the hosel but still allow the angular rotation of the ball joint. Once the desired position of the hosel is reached, the clamping nut is tightened and the whole assembly is locked in place for play.

A special tool is required for assembly of the adjustment nut and left hand/right hand screw that turns both the nut and screw until they are engaged with the hosel piece and skirt tube respectively, after which the screw is turned independently to position the hosel piece.

Further objects, features and advantages will become apparent upon consideration of the following detailed description of the invention when taken in conjunction with the drawings and the appended claims.

BRIEF DESCRIPTION OF THE DRAWINGS

FIG. 8A is an end and section view of the anchor nut

FIG. 8B is an end and section view of the linkage screw

FIG. 14 is a side exploded view of the anchor nut driver

FIG. 15 is a top exploded view of the screw and anchor nut drivers

FIG. 16 is an end view of the screw and anchor nut drivers

FIG. 17 top view of driver tools set for installation of screw and anchor nut FIG. 18 top view of driver tools set for linkage screw adjustment FIG. 19 heel section view showing range of motion of hosel mechanism FIG. 20 playing position top view of neutral face angle hosel adjustment FIG. 21 playing position top view of closed face angle hosel adjustment FIG. 22 playing position top view of open face angle hosel adjustment

DETAILED DESCRIPTION OF AN EMBODIMENT

Figure 1:
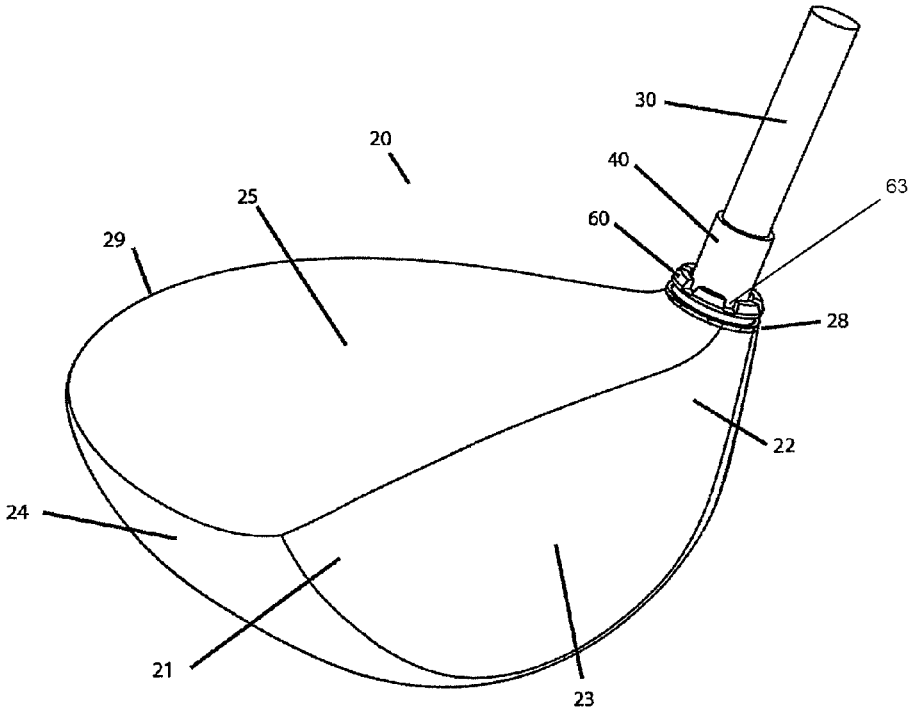
FIG. 1 is a front perspective view of a wood type head of the present invention assembled.
Figure 2:
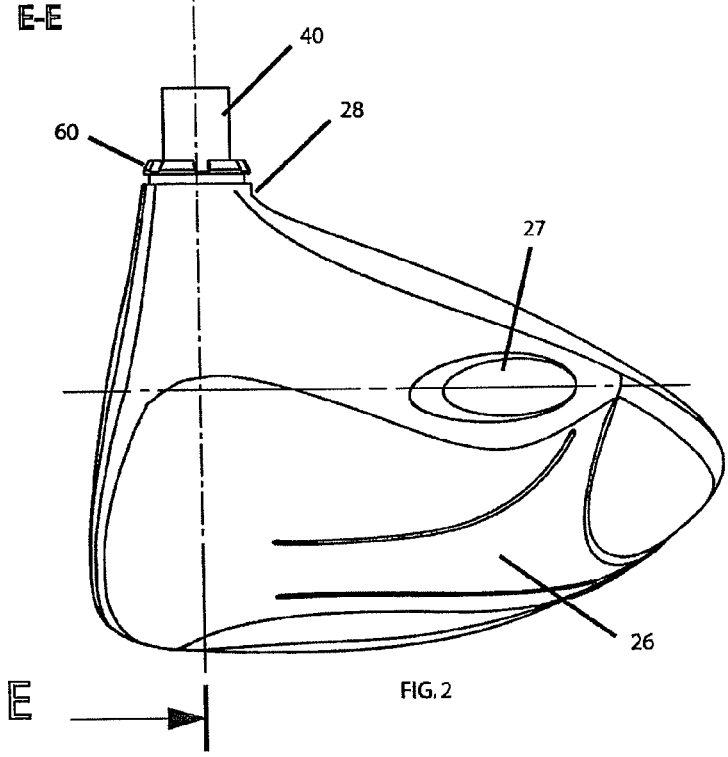
FIG. 2 is a heel side view with the adjustable hosel axis in the vertical position.

As shown in FIG. 1, a golf club is generally designated 20. The golf club 20 has a head 29 and a shaft 30 that are coupled together by means of a hosel 40. The club head 29 is a wood type golf club head having a toe 21, a heel 22, an upper crown 25, a skirt section 24, a neck 28, and a sole 26 (FIG. 2). The head 29 also has a striking face 23. The striking face 23 generally extends from the heel 22 to the toe 21 along the front of the club head 29.

Figure 5:
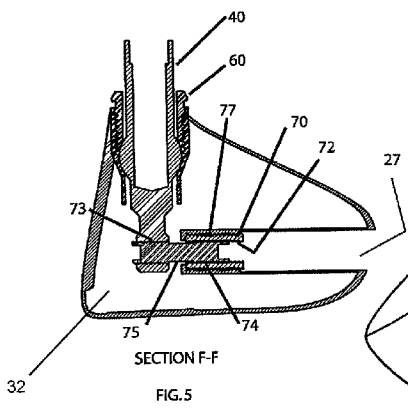
FIG. 5 is a heel rear section view along lines F-F of FIG. 4
Figure 4:
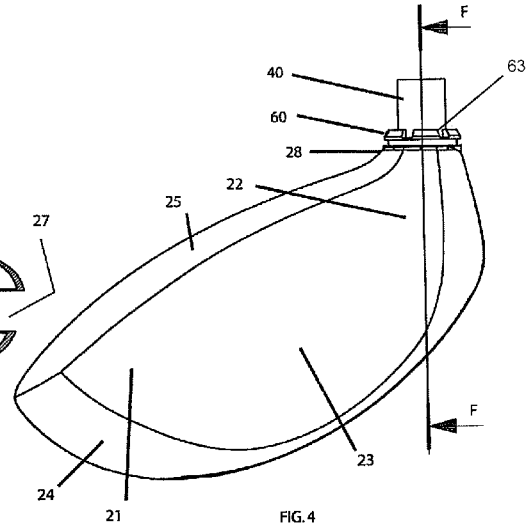
FIG. 4 is a front view with the hosel axis in the vertical position.
Figures 6, 7:
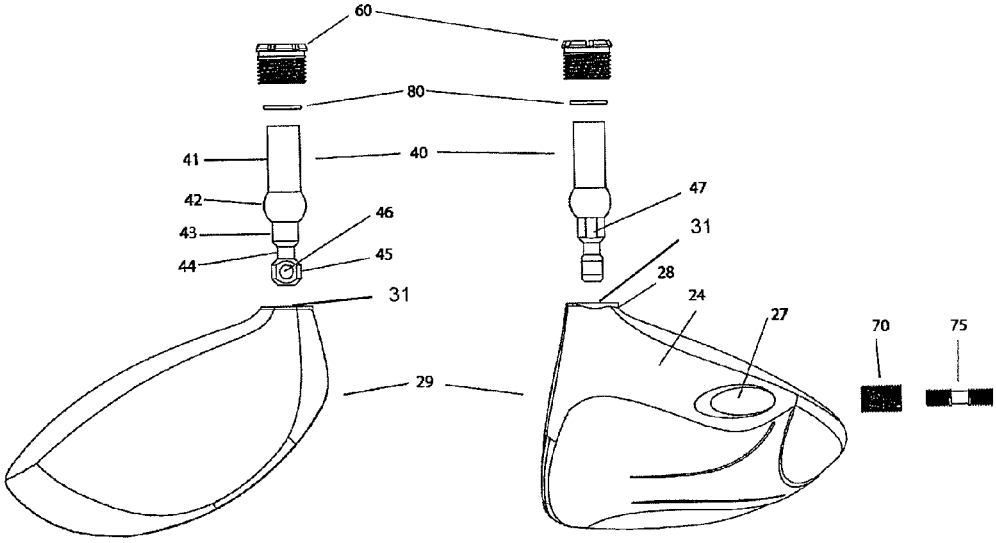
FIG. 6 is a heel side exploded view.
FIG. 7 is a front exploded view.
Figure 8:
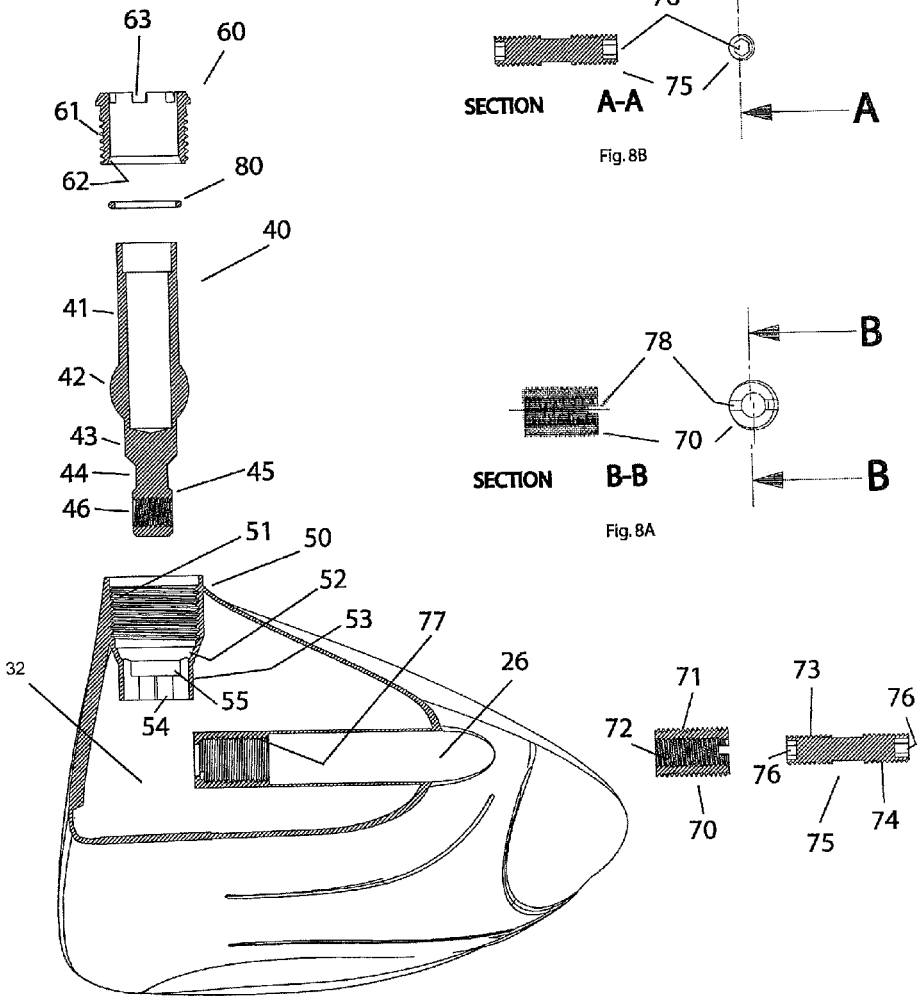
FIG. 8 is heel side exploded section view of an integral cup embodiment
Figure 19:
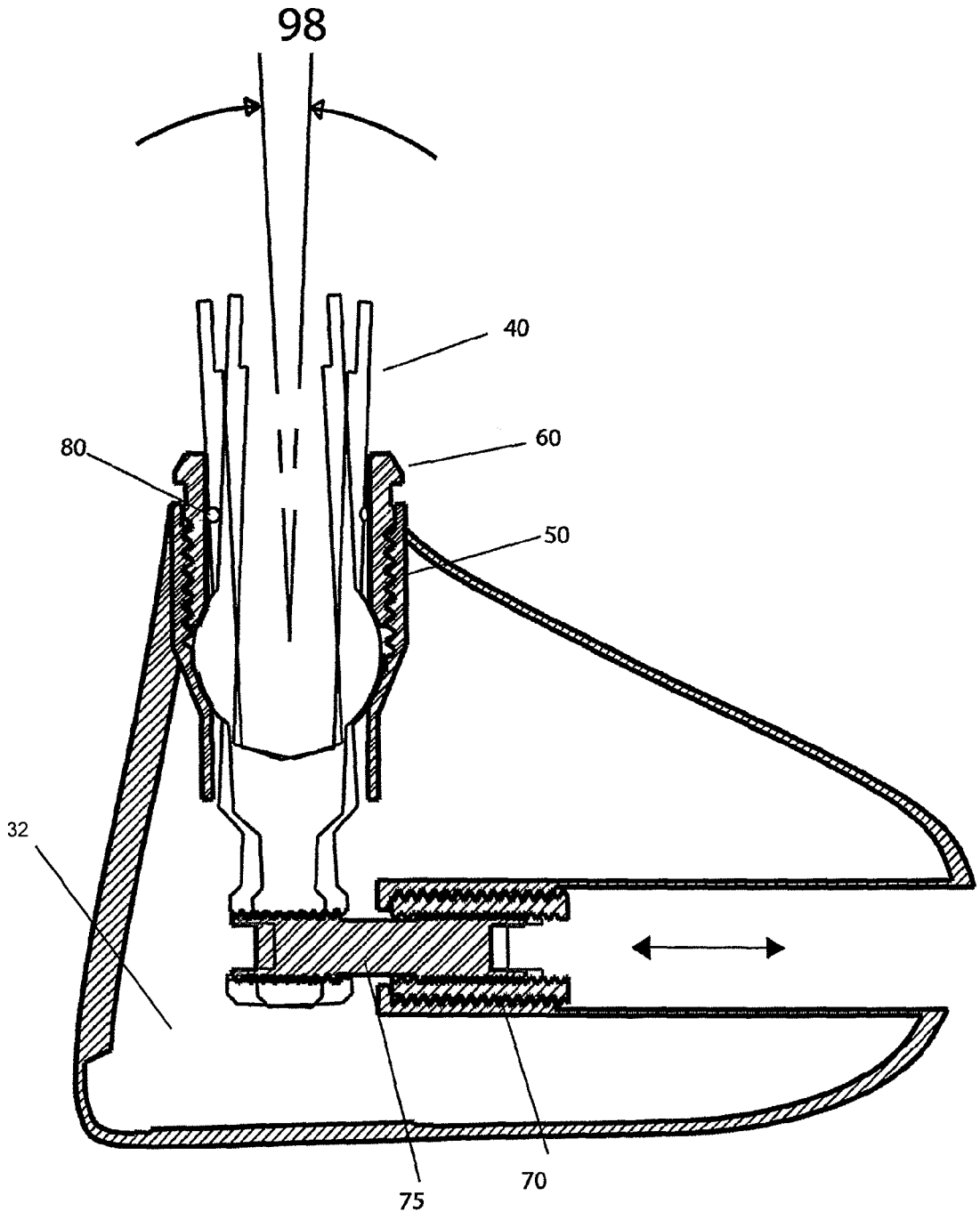

The head 29 is preferably made of a metallic material such as titanium or stainless steel or similar materials. In the preferred embodiment (FIGS. 1-8) shown of a driver, the head 29 would have a large volumetric displacement of greater than 335 cubic centimeters and weigh between 185 and 215 grams, and more preferably between 195 and 205 grams. The club head 29 is preferably hollow with an internal cavity 32 (FIGS. 5, 8, and 19). An opening 31 in the neck 28 communicates with the internal cavity 32 and is adapted for receiving a cup piece 50 and the separate hosel 40. A tube 27 extends through the skirt section 24 and communicates with the internal cavity 32. A compression nut or clamping nut 60 is placed over a top cylindrical section 41 of the hosel 40 after which the hosel 40 in turn receives the tip end of the shaft 30 which is bonded into the top cylindrical section 41 of the hosel 40 with an epoxy resin or other suitable adhesive. The shaft 30 is most preferably made of a graphite composite material and weighs in a range from 40 to 110 grams, but can be constructed from steel, stainless steel, aluminum or titanium.

The connection arrangement between the hosel 40 and the head 29 provides for easy assembly and disassembly of the shaft 30 to the head 29 as well as easy alteration of the angle between the shaft 30 and the head 29, without completely disassembling the hosel 40 and head 29, thereby allowing a multitude of customizations to be made.

The hosel 40 is preferably constructed from a metallic material such as aluminum or titanium, but also may be made from other suitable non metallic materials such as plastic. In one embodiment of the invention shown in FIG. 1 through FIG. 8, the hosel 40 is composed of the top cylindrical section 41, which contains a portion of the shaft bore hole for receiving the shaft 30, an upper spherical section 42 with a spherical surface, an intermediate rotation prevention section 43 comprising two opposing exterior flat sides 47, a lower extension section 44 connecting the intermediate rotation prevention section 43 to a bottom connector section 45 which contains a horizontally threaded hole or connector 46.

Figure 13:
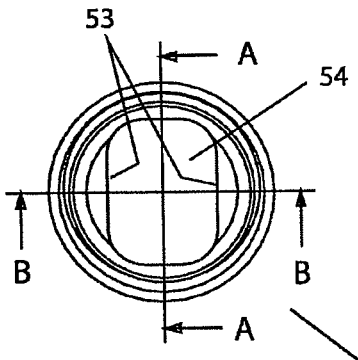
FIG. 13 is a plan view of the recess cup
Figure 12:
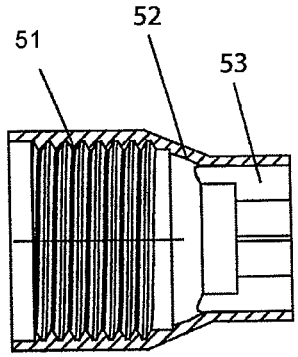
FIG. 12 is a section A-A view of FIG. 13 of the recess cup
Figure 11:
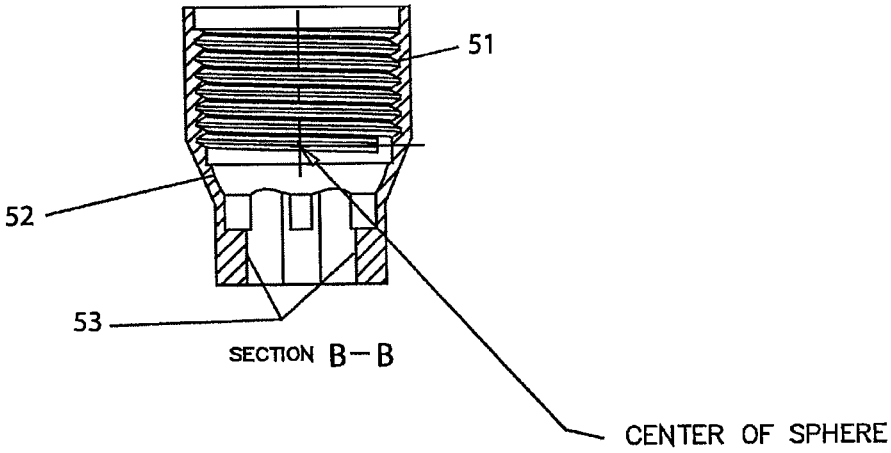
FIG. 11 is section B-B view of FIG. 13 of the recessed cup

The hosel 40 fits into the cup piece 50 (FIGS. 11-13) which is composed of a top threaded section 51, a central spherical section 52 with a spherical surface, and a bottom rotation prevention section 53 with interior flat sides 55. The spherical surfaces of the upper spherical section 42 of hosel 40 and the central spherical section 52 of the cup piece 50 match in radius, and range from 9 millimeters to 25 millimeters in diameter in order to mate together. The exterior flat sides 47 of the intermediate rotation prevention section 43 mate to the matching interior flat sides 55 of the slotted hole 54 in the bottom rotation prevention section 53. This arrangement allows the hosel 40 to tilt in a plane to and away from the face 23 while the spherical surfaces of the upper spherical section 42 and the central spherical section 52 remain in contact and while the exterior flat sides 47 and interior flat sides 55 of the intermediate rotation prevention section 43 and the bottom rotation prevention section 53 also remain in contact. The cup piece 50 (FIGS. 11-13) is preferably constructed from a metallic material such as aluminum or titanium, but also may be made from other suitable non metallic materials such as plastic.

Figure 3:
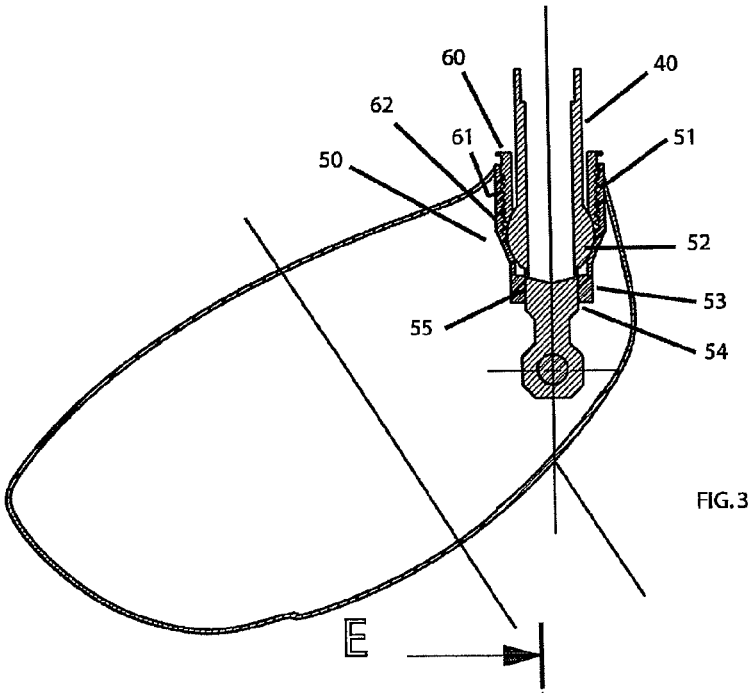
FIG. 3 is a front section view along lines E-E of FIG. 2
Figures 9, 10:
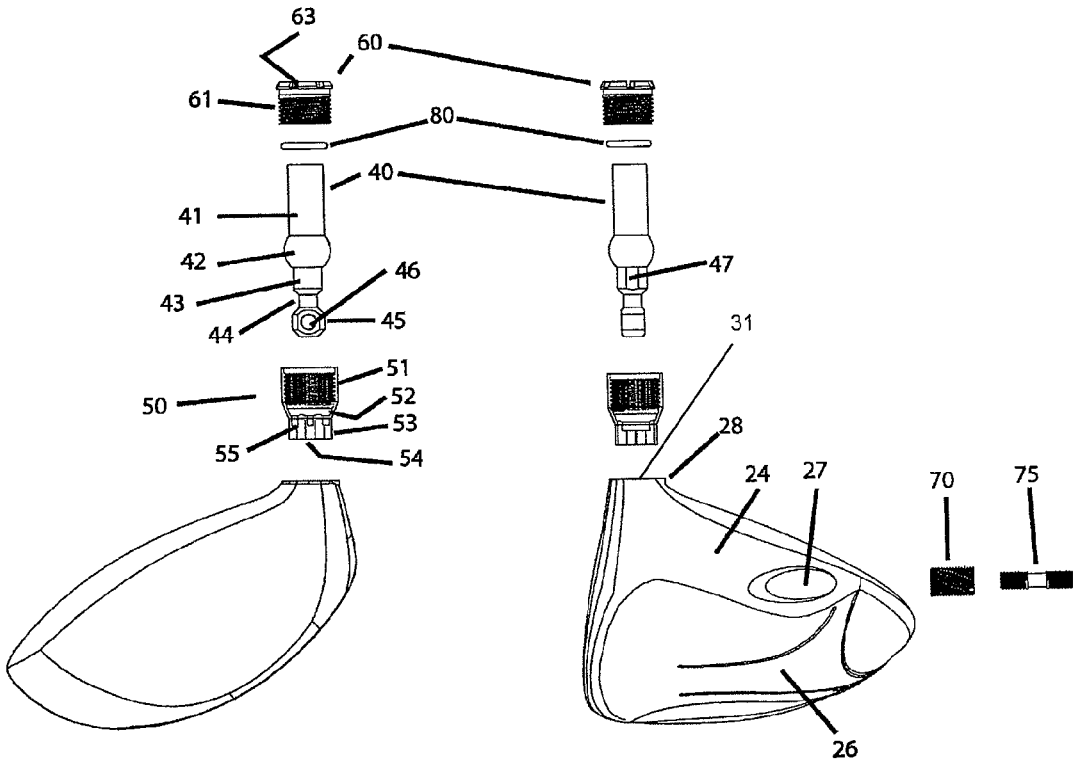
FIG. 9 is a heel exploded view of a separate cup embodiment
FIG. 10 is a front exploded view of a separate cup arrangement

The hosel 40 is locked to the cup piece 50 by a mechanical fastener. Particularly, the mechanical fastener is the clamping nut 60 (FIG. 3). The clamping nut 60 has an externally threaded section 61 and an internal spherical section 62 that matches the spherical radius of the upper spherical section 42 of the hosel 40. The clamping nut 60 fits over the top cylindrical section 41 of the hosel 40 and threadablely engages the top threaded section 51 of the cup piece 50. When the clamping nut 60 is threaded downward, the spherical surface 62 engages the spherical surface of the upper spherical section 42 of the hosel 40 and along with contact of spherical surface of the central spherical section 52 of the cup piece 50, fixes the position of hosel 40 within the cup piece 50 by friction. The clamping nut 60 is rotated by means of drive slots 63 around the periphery of the clamping nut 60. The clamping nut 60 is also preferably constructed from a metallic material such as aluminum or titanium, but also may be made from other suitable non metallic materials such as plastic. In the preferred embodiment (FIGS. 2-8) the cup piece 50 is made as an integral part of the head 29, however it can also be made as a separate piece (FIGS. 9-10) and attached to the head 29 by welding or adhesive, or any other suitable means.

The angularity of the hosel 40 with respect to the head 29 is controlled by a hosel positioning mechanism as seen in FIG. 5. The hosel positioning mechanism includes right hand internal threaded section 77 of the tube 27, a screw 75, an adjustment nut 70, and the threaded hole 46 of the hosel 40. The screw 75 has right hand threads on one end 73 and left hand threads on the opposite end 74, and a multifaceted recess 76 (FIG. 8) for receiving a driver. The adjustment nut 70 has right hand exterior threads 71 that match the pitch of the right hand threads on the end 73 of the screw 75. The adjustment nut 70 has left hand internal threads 72 that match and engage the left hand threads on the end 74 of the screw 75. The adjustment nut 70 also has a slot 78 in one end for receiving a flat head type screw driver. The right hand threads on end 73 of screw 75 engage the internal right hand threads of horizontal threaded hole 46 of bottom section 45 of the hosel 40.

The adjustment nut 70 is threaded into the base of the tube 27 located in the heel side of the skirt 24 of the head 29. The tube 27 has a right hand threaded section 77 to engage the right hand threads of the exterior threads 71 of the adjustment nut 70. The tube 27 is located such that its axis is in line with the axis of threaded hole 46 when the central spherical surface 42 of hosel 40 is seated against central spherical surface 52 of the cup piece 50. An adhesive is applied between the exterior threads 71 of the adjustment nut 70 and internal threads 77 of the tube 27 to prevent rotation of the adjustment nut 70 when the screw 75 is turned to reposition the hosel 40.

Figure 20:
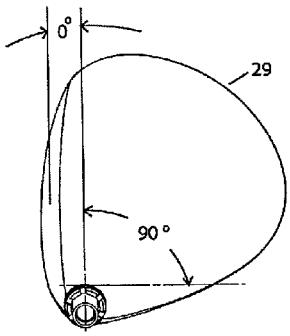
Figure 21:
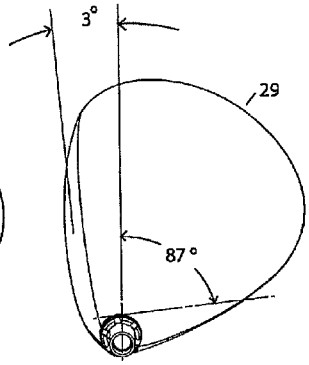
Figure 22:
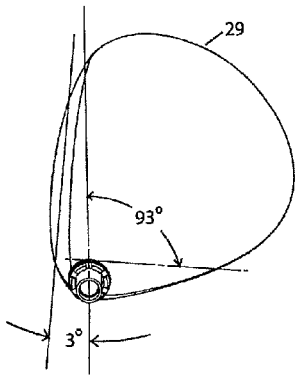

The screw 75 and bottom connector section 45 of the hosel 40 are assembled by first partially threading the adjustment nut 70 onto the left hand threads of the end 74 of screw 75. The adjustment nut 70 and the screw 75 are then placed into the tube 27 and turned and advanced together along the internal threaded section 77 as one unit by a special driver tool 90 (FIGS. 14-18). The special driver tool 90 has a nut driver body 91 with driver tangs on one end 92 that engage the driver slot 78 on the adjustment nut 70 and a through hole 96 that receives driver shaft 94 that engages the screw 75. For insertion or removal the driver body 91 is located along the driver shaft 94 such that both the nut driver body 91 and the driver shaft 94 engage the driver slot 78 and multifaceted recess 76 respectively. The nut driver body 91 is then secured to the driver shaft 94 by means of set screw 97 in threaded hole 93 allowing both the nut driver body 91 and the driver shaft 94 to be turned as a single unit by handle 95. As the right hand internal threads 77 of the tube 27 are engaged by the adjustment nut 70, the screw 75 comes in contact with threaded hole 46 of the hosel 40, and the screw 75 engages hosel bottom connector section 45. Threaded hole 46 has slightly oversized threads to allow for rotation of the hosel 40 about the center of the spherical surface of the upper spherical section 42 of the hosel 40. After the adjustment nut 70 is bottomed in the tube 27, the screw 75 can be turned independently by the driver shaft 94 after disengaging the set screw 97 and relocating the nut driver body 91, pulling and pushing the bottom connector section 45 of hosel 40, and tilting the angle 98 of the hosel 40 in a direction toward and away from the face 23 (FIG. 19). Thus, by loosening the clamping nut 60 a small amount, turning the screw 75 to the desired position and retightening clamping nut 60, the face angle of the head 29 as well as the effective loft angle (FIGS. 20-22) can be customized to the individual. The relationship between the face angle and effective loft of a driver head 29 can be explained using FIGS. 20-22). When the hosel 40 is in the neutral position (FIG. 20)

the face angle is square to the target line and the effective loft of the head is the same as the nominal loft angle between the sole and the face center, in this example 10 degrees. When the hosel 40 is tilted approximately 1.5 degrees toward the target or enough to close the face angle 3 degrees in the playing position (FIG. 21), the effective loft becomes greater by 3 degrees and would be approximately 13 degrees. When the hosel 40 is tilted away from the target line by approximately 1.5 degrees or enough to open the face angel by 3 degrees in the playing position (FIG. 22), the effective loft becomes less by about 3 degrees and would be approximately 7 degrees. These angular alterations greatly effect the direction, left or right, and the elevation, high and low, of a ball being struck by the present invention and enable a wide range of customization for an individual golfer. In addition, the entire shaft/hosel assembly may be changed by disengaging screw 75 from the hosel bottom connector section 45 and disengaging clamping nut 60, and reassembling with a different shaft and hosel, thus further customizing the club.

From the foregoing description it is believed that those skilled in the art will recognize and appreciate the advancement of the art in this invention and will readily understand that while the present invention has been described in association with a preferred embodiment thereof, and other embodiments illustrated in the accompanying drawings, many changes additions and substitutions of equivalents may be made without departing from the sprit and scope of this invention which is intended to be unlimited by the foregoing except as may appear in the following appended claims:

We claim:

1. A golf club head comprising:

a. an upper crown, a neck, a sole, a front striking face, a heel, a toe, a skirt section between the crown and the sole, an internal cavity, and an opening in the neck communicating with the internal cavity;

b. a cup piece positioned in the opening and comprising:

i. an top threaded section for receiving a clamping nut;

ii. a central spherical section having a spherical surface; and iii. a bottom rotation prevention section comprising at least two interior opposing flat sides;

c. a hosel for insertion into the cup piece and comprising:

i. an top cylindrical section for receiving a golf shaft;

ii. a upper spherical section having a spherical surface for engaging the spherical surface of the central spherical section of the cup piece; and iii. an intermediate rotation preventing section having at least two exterior flat sides for engaging the at least two interior opposing flat sides of the cup piece; and iv. a bottom connector section with a connector having connector threads;

d. a hosel positioning mechanism comprising:

i. a tube extending through the skirt into the internal cavity and having an internal threaded section;

ii. an adjustment nut having internal threads and having external threads for engaging the internal threaded section of the tube; and iii. a screw that engages the threaded connector of the bottom section of the hosel and engages the internal threads of the adjustment nut; and e. a mechanical fastener for locking the hosel to the cup piece.

2. The golf club head according to claim 1, wherein the interior flat sides of the bottom rotation prevention section of the cup section define an elongated slot disposed in such a manner that the two opposing interior flat sides of the cup piece slidably engage the two opposing exterior flat sides of the hosel to allow rotation of the hosel about a center of the spherical surface of the upper spherical section of the hosel in only one axis.

3. The golf club head according to claim 1, wherein the mechanical fastener is a clamping nut, comprising an external threaded section that threadably engages the top threaded section of the cup piece, an internal spherical section that engages the spherical surface of the upper spherical section of the hosel when the clamping nut is tightened, and a hole through the clamping nut large enough for clearing the top cylindrical section of the hosel and allowing the hosel to rotate about the upper spherical section of the hosel at least plus or minus 1 degree.

4. The golf club head according to claim 1, wherein the golf club head further comprises an adhesive applied between the exterior threads of the adjustment nut and the internal threads of the tube to prevent rotation of the adjustment nut when the screw is turned to reposition the hosel piece.

5. The golf club head according to claim 1, where the upper spherical section of the hosel is between 9 and 25 millimeters in diameter.

6. The golf club head according to claim 1 wherein the upper spherical section of the hosel has a diameter, the central spherical section of the cup piece has a diameter, and the spherical section of the clamping nut has a diameter, and the diameters are approximately equal.

7. The golf club head according to claim 1, wherein the golf club head further comprises a sealing gasket between the top cylindrical section of the hosel and the clamping nut.

8. The golf club head according to claim 1, wherein the adjustment nut has opposite hand threads on its exterior and interior.

9. The golf club head according to claim 1, wherein the screw that engages the bottom connector section of the hosel and engages the adjustment nut has opposite hand threads on opposite ends.

10. The golf club head according to claim 1, wherein the pitch of the exterior threads of the adjustment nut and the pitch of the connector threads of the connector of the bottom connector section of the hosel are the same.

11. The golf club head according to claim 1, wherein the hosel, the cup piece, and the hosel positioning mechanism are composed of a metallic material.

12. The golf club head according to claim 1, wherein the cup piece is integrally formed with the head.

* * * * *